US006399167B1

(12) United States Patent
Lewis, Jr.

(10) Patent No.: US 6,399,167 B1
(45) Date of Patent: Jun. 4, 2002

(54) ORNAMENT WITH PRINTED INSERT

(76) Inventor: James W. Lewis, Jr., 3967 Bismarck Dr., San Jose, CA (US) 95130-1203

( * ) Notice: Subject to any disclaimer, the term of this patent is extended or adjusted under 35 U.S.C. 154(b) by 14 days.

(21) Appl. No.: 09/612,865

(22) Filed: Jul. 10, 2000

(51) Int. Cl.[7] ..... A47G 33/04

(52) U.S. Cl. ..... 428/11; 428/13; 428/14; 428/542.2

(58) Field of Search ..... 428/11, 13, 14, 428/34.1, 34.4, 542.2

(56) References Cited

U.S. PATENT DOCUMENTS

| | | | | | |
|---|---|---|---|---|---|
| 2,519,248 | A | * | 8/1950 | Hulbert | 46/100 |
| 3,694,648 | A | * | 9/1972 | Yates | 240/10 |
| 4,173,667 | A | * | 11/1979 | Rusch | 428/11 |
| 4,224,364 | A | * | 9/1980 | Hunt | 428/11 |
| 4,309,464 | A | * | 1/1982 | Rauch | 428/11 |
| 4,833,580 | A | * | 5/1989 | Allen | 362/451 |
| 4,889,748 | A | * | 12/1989 | Dudley | 428/11 |
| 4,996,087 | A | * | 2/1991 | Rebstock | 428/11 |
| 5,254,026 | A | * | 10/1993 | Kaiser | 446/220 |
| 5,378,512 | A | * | 1/1995 | Van Wyk | 428/11 |
| 5,458,930 | A | * | 10/1995 | Brown | 428/11 |
| 6,022,437 | A | * | 2/2000 | White | 156/212 |
| 6,217,956 | B1 | * | 4/2001 | Heidkamp | 428/11 |

* cited by examiner

*Primary Examiner*—Christopher P. Schwartz
*Assistant Examiner*—Benjamin A Pezzlo
(74) *Attorney, Agent, or Firm*—Patrick T. Bever; Law Offices of Bever, Hoffman & Harms

(57) ABSTRACT

An ornament having a printed insert bearing a personalized message or picture that is suspended within a transparent bulb. The printed insert is produced by printing the personalized message or picture onto transparency paper using a computer and color printer, and cutting the transparency paper to form a disk-shaped insert that is sized to fit within the transparent bulb. The printed insert is then curled and inserted through the opening of the transparent bulb, and is then suspended within the transparent bulb from a cap using a hitch pin (fastener).

20 Claims, 3 Drawing Sheets

ORNAMENT WITH PRINTED INSERT

FIELD OF THE INVENTION

The present invention relates to hanging ornaments, and more particularly to ornaments typically hung on Christmas trees.

BACKGROUND

Hanging bulb-like ornaments have long been utilized to decorate Christmas trees. Some of these ornaments have personalized messages or pictures printed thereon that evoke memories of past holidays and events, and are therefore highly desirable. Unfortunately, printing personalized messages or pictures on the curved exterior surface of a bulb-like ornament is tedious and therefore very expensive.

What is needed is method of producing bulb-like ornaments having personalized messages and/or pictures that is both attractive and cost effective.

SUMMARY

The present invention is directed to an ornament characterized by a printed insert bearing a personalized message or picture that is suspended within a transparent bulb. The printed insert is produced by printing the personalized message or picture onto transparency paper using a computer and color printer, and cutting the transparency paper to form a disk-shaped insert that is sized to fit within the transparent bulb. The printed insert is then curled and inserted through the opening of the transparent bulb, and is then suspended within the transparent bulb from a cap using a hitch pin (fastener). Because the indicia is printed on a flat sheet using known methods and equipment, a personalized ornament is inexpensively and conveniently produced that avoids the expensive and complicated conventional method of printing on a spherical surface.

The present invention is also directed to a method for making personalized ornaments that includes the steps of printing messages or pictures onto a transparency sheet, cutting the transparency sheet to form an insert, connecting the insert to a cap, and then inserting the insert into a transparent bulb until the cap is mounted over an opening of the transparent bulb and the insert is suspended in an interior chamber of the transparent bulb.

In accordance with another aspect of the present invention, a tool is provided for curling the insert before insertion into the bulb, thereby greatly simplifying the production of multiple ornaments.

The present invention is also directed to a kit (assembly) for producing the novel ornaments. The kit includes a transparent bulb, instructions and/or materials for producing the printed inserts, and the curling tool described above.

The present invention will be more fully understood in view of the following description and drawings.

DETAILED DESCRIPTION

Figure 1:
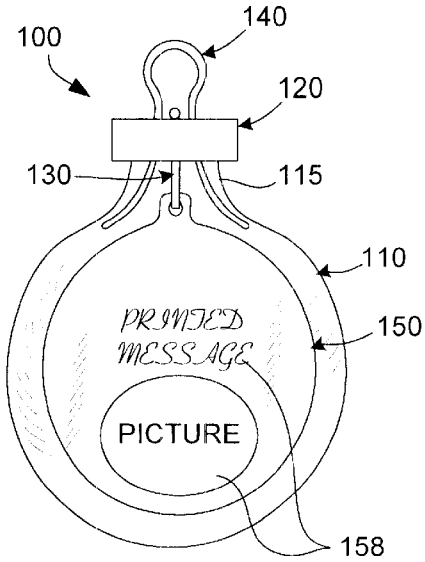
FIG. 1 is a front elevation view showing an ornament according to the present invention.

FIG. 1 is a front elevation view showing an ornament 100 according to the present invention. Ornament 100 includes a transparent bulb 110, a cap 120 mounted on a neck portion 115 of transparent bulb 110, a hitch pin (fastener) 130 connected to cap 120 and extending into transparent bulb 110, a hanger 140, and a printed insert 150 secured by hitch pin 130 such that printed insert 150 hangs inside transparent bulb 110. According to the preferred embodiment of the present invention, printed insert 150 is cut from a sheet of transparency paper (acetate film) such that printed (ink) messages and/or pictures (indicia) 158 printed thereon are easily viewed in ambient light. Because printed insert 150 is formed from transparency paper and indicia 158 is printed using widely available equipment, the production of attractive personalized ornaments is greatly simplified by the present invention.

Figure 2:
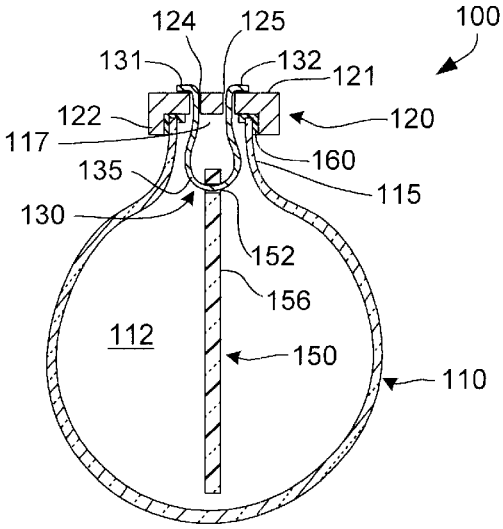
FIG. 2 is a cross-sectional side view showing the ornament of FIG. 1.
Figure 3:
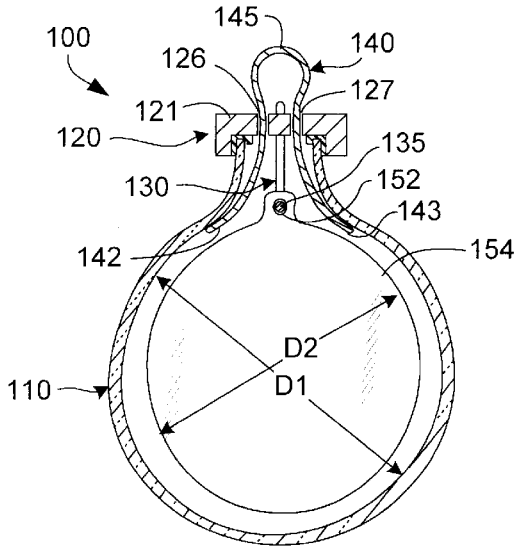
FIG. 3 is a cross-sectional back view showing the ornament of FIG. 1.

FIGS. 2 and 3 are cross-sectional side and back views of ornament 100.

Referring to FIG. 2, transparent bulb 110 includes a glass or plastic outer wall that surrounds an interior chamber 112 and communicates with an opening 117 located at an upper edge of neck portion 115. When transparent bulb 110 is made from glass, an optional protective film 160 (e.g., paint and/or plastic dip) is preferably deposited on the upper edge of neck portion 115 (around opening 117) to prevent chipping. Referring to FIG. 3, interior chamber 112 is essentially spherical and has a diameter D1 that, in one embodiment, is approximately equal to 3 inches. Suitable transparent bulbs are produced by Rauch Industries, Inc. of Gastonia, N.C.

Cap 120 is seated over opening 117, and includes a top plate 121 and a cylindrical side plate 122 extending down from top plate 121. Top plate 121 includes a first pair of holes 124 and 125 to facilitate the attachment of hitch pin 130 (see FIG. 2), and a second pair of holes 126 and 127 to facilitate the attachment of hanger 140. Holes 124, 125, 126, and 127 are preferably formed using a punch.

Referring to FIG. 2, hitch pin 130 has a first portion (i.e., free ends 131 and 132) attached to cap 120, and a central loop (second) portion 135 extending into interior chamber 112 of transparent bulb 110. Free ends 131 and 132 of hitch pin 130 extend through corresponding first and second holes 124 and 125 formed in top plate 121. Central loop portion 135 passes through a hole 152 formed in printed insert 150, thereby securing printed insert 150 and suspending it within interior chamber 112. While hitch pin 130 represents a presently preferred fastener for securing printed insert 150, other fastener types (e.g., string, ribbon, or wire) may also be used.

Referring to FIG. 3, hanger 140 is a conventional ornament hanger having lower ends 142 and 143 extending into transparent bulb 110 through corresponding (third and fourth) holes 126 and 127 formed in top plate 121 of cap 120, and a central loop portion 145 located adjacent to top plate 121 of the cap 120.

As mentioned above and described in additional detail below, printed insert 150 is cut from a sheet of transparency paper and includes indicia 158 printed onto a front surface 156 thereof using a conventional color (e.g., ink jet) printer. Also mentioned above, printed insert 150 includes hole 152 by which it is suspended in interior chamber 112 by hitch pin 130. Referring to FIG. 3, in a preferred embodiment, printed insert has a curved outer edge 154 that is substantially circular and has a diameter D2 that is smaller than diameter D1 of interior chamber 112. Accordingly, printed insert 150 is able to rock and turn within transparent bulb 110, restricted only by the connection to hitch pin 130. Of course, printed inserts having non-circular outer edges (e.g., square, diamond, oval, etc.) may also be used, provided the selected shape permits swinging movement. In yet another embodiment, printed inserts having outer edges that press against the inner walls of the transparent bulb may also be used, but these inserts are currently considered less attractive than printed inserts sized to swing freely in the transparent bulb.

While the disclosed embodiment describes printed insert 150 as being formed using transparency paper, printed inserts may be formed using other transparent, semi-transparent or opaque materials (e.g., plastic or foil).

Figure 4:
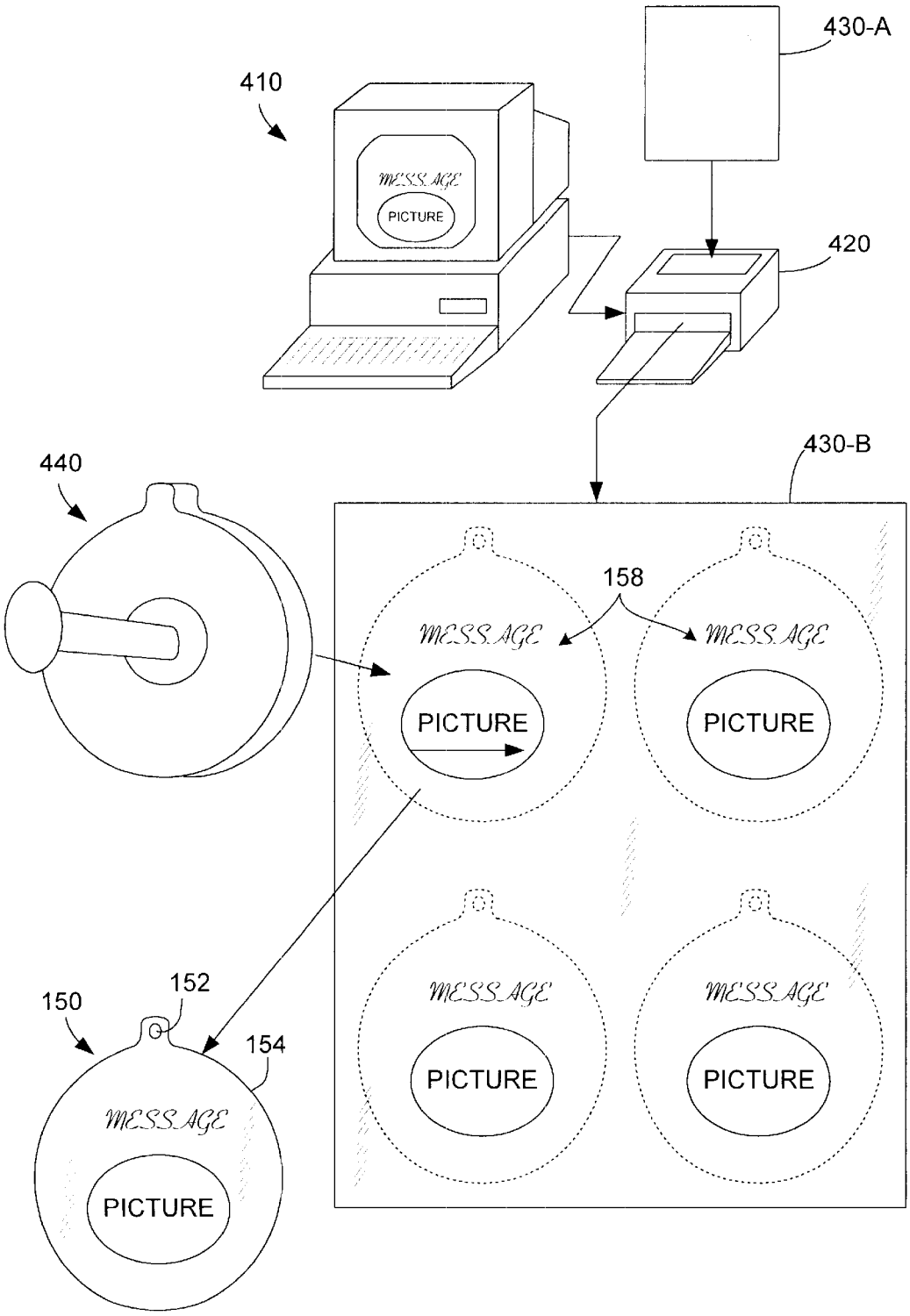
FIG. 4 is a diagram illustrating a method for producing a printed insert for an ornament according to the present invention.

FIG. 4 illustrates a method of producing printed insert 150 according to another aspect of the present invention. In particular, a personalized message and/or picture are generated using a personal computer 410 (e.g., an IBM PC or clone controlled by a Microsoft Windows operating system software package) running well-known desk-top publishing software (e.g., Microsoft Excel, Adobe Photoshop, Microsoft Paint, and/or Microsoft Photo Editer). Once a personalized message and/or photograph are configured in a desired format, they are transmitted to a printer 420 (e.g., color printers produced by Hewlett Packard under model numbers HP 932C, HP 875C, or HP 1120CXS) for printing on a blank transparency sheet 430-A. For best printing results using printers not specifically configured for printing on transparency film, enhanced color settings should be designated through the desk-top publishing software. Printed transparency sheet 430-B includes multiple indicia groups 158 that can be cut out to form multiple ornaments. The cut-out process is greatly enhanced using a substantially disk-shaped die 440 that has a sharp edge defining the appropriate substantially circular outer edge 154 of printed cut out 150. Alternatively, scissors or other cutting instruments may be used to separate printed transparency sheet 430-B into separate printed inserts 150. Unless produced for by die 440, hole 152 is preferably formed using a punch to facilitate the suspension of printed insert 150 using hitch pin 130.

Referring back to FIG. 2, once printed insert 150 is cut out, hitch pin 130 is inserted through opening 152, and then connected to cap 120.

To insert printed insert 150 into transparent bulb 110, it is necessary to curl printed insert 150 into a cylindrical shape, and then slide the curled printed insert 150 through opening 117 provided in the neck 115 of transparent bulb 110. Upon completion of this insertion process, cap 120 seats on the upper edge of neck 115, and printed insert 150 hangs within interior chamber 112 as shown in FIG. 2.

Figure 5:
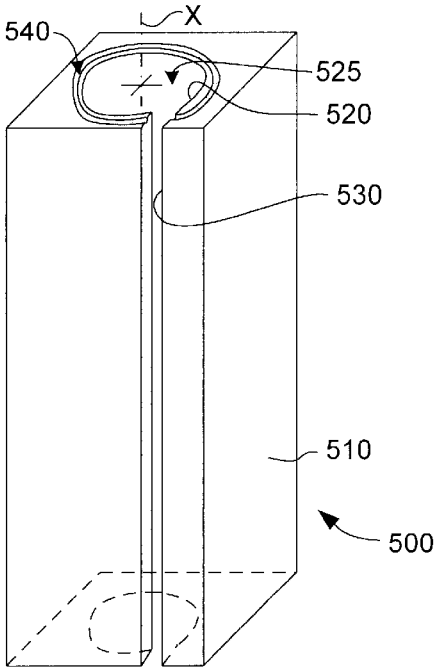
FIG. 5 is a perspective view showing a tool for inserting printed inserts into ornament bulbs according to another aspect of the present invention.

FIG. 5 is a perspective view showing a tool 500 provided to facilitate insertion of printed (flat or sheet-like) insert 150 into transparent bulb 110. Tool 500 includes an elongated block 510 having a plurality of sides surrounding a substantially cylindrical inner surface 520 forming a cylindrical central chamber 525. Cylindrical central chamber 525 defines an axis X that is parallel to the sides of block 510. A slit 530 if formed in one of the sides of block 510 that communicates with cylindrical central chamber 525 such that when the printed insert 150 is slid into slit 530, printed insert 150 is bent by cylindrical inner surface 520 into a cylinder for insertion through the opening 117 formed in the transparent bulb 110. Finally, circular groove 540 is provided on an end surface of tool 500 around cylindrical central chamber 525 for receiving the edge of transparent bulb 110.

Figure 6A:
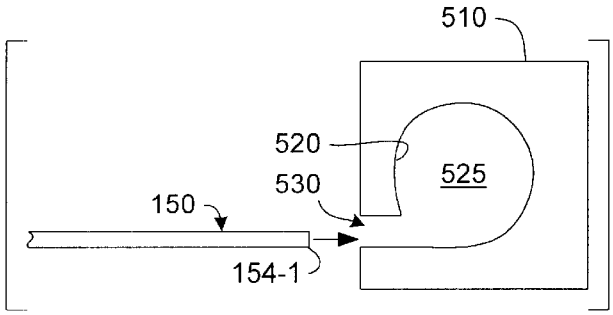
FIGS. 6(A), 6(B), and 6(C) are end views showing a process of curling the printed insert using the tool shown in FIG. 5.
Figure 6B:
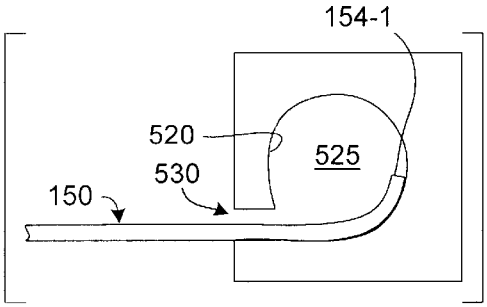
Figure 6C:
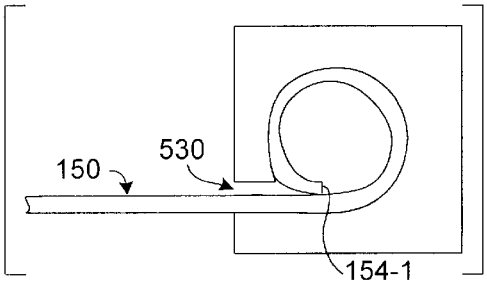

FIGS. 6(A) through 6(C) depict the curling process performed by tool 500. As a leading edge 154-1 of printed insert 150 is pressed through slit 530, leading edge 154-1 slides against cylindrical inner surface 520, thereby causing printed insert 150 to curl into a cylindrical shape.

Figure 7:
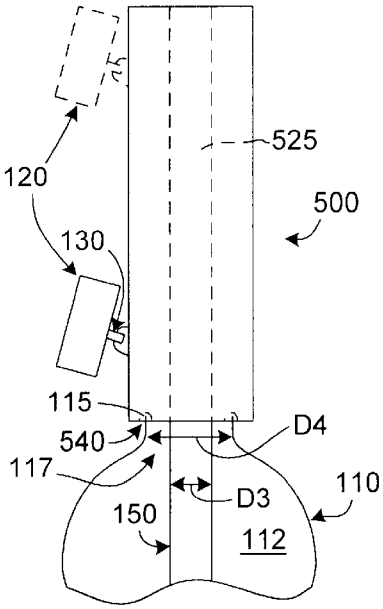
FIG. 7 is a side elevation view showing a process of inserting the printed insert into an ornament bulb using the tool shown in FIG. 5.

FIG. 7 depicts the process of inserting the curled printed insert 150 into transparent bulb 110. Note that a (third) diameter D3 of cylindrical central chamber 525 is smaller than a (fourth) diameter of opening 117, thereby allowing curled printed insert 150 to slide into interior chamber 112 of transparent bulb 110 when tool 500 is mounted onto the upper edge of neck portion 115. Note also that hitch pin 130 and cap 120 are secured to printed insert 150 before insertion into transparent bulb 110. Once printed insert 150 is free from tool 500 and inside central chamber 112 of transparent bulb 110, printed insert 150 resiliently returns to its original disk-like shape.

As suggested above, in addition to the specific embodiments disclosed herein, other modifications are also possible that fall within the spirit and scope of the present invention. For example, printed inserts may be produced using any known printing method, such as lithography. Therefore, the invention is limited only by the following claims.

What is claimed is:

1. An ornament comprising:

a transparent bulb having an interior chamber having a neck portion defining an opening;

a cap seated over the opening;

a fastener having a first portion attached to the cap and a second portion extending into the interior chamber of the transparent bulb; and a printed insert secured by the second portion of the fastener such that the printed insert hangs in the interior chamber of the transparent bulb and is movable relative to the transparent bulb.

2. The ornament of claim 1, wherein interior chamber of the transparent bulb has a first diameter, and wherein a curved outer edge of the printed insert defines a second diameter that is smaller than the first diameter.

3. The ornament of claim 1, wherein the printed insert comprises acetate film and includes one or more ink markings formed on a surface thereof.

4. The ornament of claim 1, wherein the fastener comprises a hitch pin, wherein the first portion of the hitch pin comprises first and second free ends, and wherein the second portion of the hitch pin comprises a central loop portion, wherein the first and second free ends of the hitch pin extend through first and second holes formed in a top plate of the cap, and wherein the central loop portion of the hitch pin extends through a hole formed in the transparent insert.

5. The ornament of claim 4, further comprising a hanger having first and second free ends extending through third and fourth holes formed in the top plate of the cap, and a central loop portion located adjacent to a top plate of the cap.

6. The ornament of claim 1, wherein the transparent bulb is glass, and wherein the ornament further comprises a protective film formed on the neck portion around the opening.

7. The ornament of claim 6, wherein the protective film comprises at least one of paint and plastic dip.

8. A method for making an ornament comprising:

printing indicia onto a transparency sheet;

cutting the transparency sheet to form an insert including the printed indicia;

connecting the insert to a cap; and inserting the insert into a transparent bulb through an opening formed in a neck of the transparent bulb such that the cap is mounted over the opening and the insert is suspended in an essentially spherical interior chamber of the transparent bulb.

9. The method according to claim 8, wherein the step of printing indicia comprises transferring an image onto the transparency sheet using a color printer.

10. The method according to claim 8, wherein the interior chamber of the transparent bulb has a first diameter, and wherein the step of cutting the insert comprises stamping the transparency sheet using a disk-shaped die such that an outer edge of the stamped printed insert has a second diameter that is smaller than the first diameter of the interior chamber.

11. The method according to claim 10, wherein the step of cutting the printed insert further comprises punching a hole in the printed insert, and wherein the step of connecting the printed insert to the cap comprises:

inserting a hitch pin through the hole such that the hole is located adjacent to a central loop portion of the hitch pin; and inserting free ends of the hitch pin into first and second holes formed in a top plate of the cap.

12. The method according to claim 11, further comprising the step of inserting free ends of a hanger through third and fourth holes formed in the top plate of the cap such that a central loop portion of the hanger is located on an opposite side of the top plate relative to the loop portion of the hitch pin.

13. The method of claim 8, wherein the step of inserting the insert into the transparent bulb comprises:

curling the insert into a cylinder having a third diameter that is smaller than a fourth diameter defined by the opening of the transparent bulb; and sliding the curled insert through the opening formed in the transparent bulb until the cap contacts an edge of the transparent bulb that surrounds the opening.

14. The method according to claim 13, wherein the step of curling the insert comprises sliding the insert into a slit formed in a block having a cylindrical inner surface such that the insert is bent by the cylindrical inner surface.

15. The method according to claim 8, further comprising depositing a protective film on the neck portion around the opening.

16. An assembly for producing an ornament, the assembly comprising:

a transparent bulb having an interior chamber having a neck portion defining an opening;

means for forming the flat insert; and a tool for inserting the flat insert into the central chamber of the transparent bulb, the tool including an elongated block having a plurality of sides surrounding a cylindrical inner surface that defines a cylindrical central chamber, the cylindrical central chamber defining an axis that is parallel to the plurality of sides, wherein one of the plurality of sides defines a slit communicating with the cylindrical central chamber such that when the flat insert is slid into the slit, the flat insert is bent by the cylindrical inner surface into a cylinder.

17. The assembly according to claim 16, wherein the tool further comprises a circular groove formed on the block around an end of the cylindrical central chamber for receiving the neck portion of the transparent bulb.

18. The assembly according to claim 16, wherein the central chamber of the transparent bulb defines a first diameter, and wherein the means for forming the flat insert comprises a transparency sheet for receiving printed indicia, and a die for stamping the transparency sheet such that an outer edge of the flat insert has a second diameter that is smaller than the first diameter of the interior chamber.

19. The assembly according to claim 16, wherein the means for forming the flat insert comprises a color printer for printing the indicia onto the transparency sheet.

20. The assembly according to claim 16, further comprising:

a cap having a top plate for covering the opening of the transparent bulb;

a hitch pin having first and second ends inserted through first and second holes formed in the top plate of the cap, and a central loop portion for securing the flat insert; and a hanger having first and second free ends extending through third and fourth holes formed in the top plate of the cap, and a central loop portion located adjacent the top plate of the cap.

* * * * *